United States Patent [19]

Heiser et al.

[11] Patent Number: 4,478,136

[45] Date of Patent: Oct. 23, 1984

[54] ELECTROHYDRAULIC CONTROL ARRANGEMENT FOR HYDROSTATIC MACHINE

[75] Inventors: Joachim Heiser, Stuttgart; Volkmar Leutner, Friolzheim; Eckard Schuttenberg, Stuttgart; Dieter Weigle, Urach, all of Fed. Rep. of Germany

[73] Assignee: Robert Bosch GmbH, Stuttgart, Fed. Rep. of Germany

[21] Appl. No.: 405,094

[22] Filed: Aug. 4, 1982

[30] Foreign Application Priority Data

Aug. 21, 1981 [DE] Fed. Rep. of Germany ..... 3133110
Apr. 16, 1982 [DE] Fed. Rep. of Germany ..... 3213958

[51] Int. Cl.[3] ..... F04B 1/30; F15B 9/10; F15B 13/16

[52] U.S. Cl. ..... 91/506; 60/389; 60/444; 417/222

[58] Field of Search ..... 417/218, 222; 60/443, 60/444, 388, 389; 91/506, 361, 459, 372

[56] References Cited

U.S. PATENT DOCUMENTS 2,974,639 3/1961 O'Connor et al. ..... 91/388 X
2,993,477 7/1961 Panissidi ..... 91/388 X
3,009,447 11/1961 Lloyd ..... 91/388 X
3,875,849 4/1975 Patel ..... 91/367
4,375,942 3/1983 Olson ..... 417/222

FOREIGN PATENT DOCUMENTS 2513548 10/1976 Fed. Rep. of Germany ..... 417/218
2823559 12/1979 Fed. Rep. of Germany ..... 60/447
423936 9/1974 U.S.S.R. ..... 417/222

*Primary Examiner*—Edward K. Look
*Attorney, Agent, or Firm*—Michael J. Striker

[57] ABSTRACT

An electrohydraulic control arrangement for a hydrostatic machine with displacing element having a stroke determined by a control member, which has at least one pressure-actuated regulating piston arranged to adjust the control member, and a valve slider through which a pressure medium acts upon the regulating piston and which is withdrawable to a neutral position in response to adjusting the machine by a feedback signal coming from the control member in correspondence with an electrical input signal, wherein a constant pressure acts upon one side of the valve slider and a variable pressure depending upon a position of the control member acts upon the other side of the valve slider.

12 Claims, 5 Drawing Figures

10
10'
11
12
12'
12''
13
14
15
16
17
18
19
20
21
22
23
24
25
27
28
29
30
31
32
34
35
36
37
38
39
41
42
43
44
45
46
47
48
49
51
52
53
54
56
57
58
58'
59
60
60'
61
62
63
64
65
66
67
69
70
71
72
73
74
75
76
77
78
79
80
82
83
84
100
101

ELECTROHYDRAULIC CONTROL ARRANGEMENT FOR HYDROSTATIC MACHINE

BACKGROUND OF THE INVENTION

The present invention relates to an electrohydraulic control arrangement for a hydraulic machine.

Electrohydraulic control arrangements for hydrostatic machines are known in the art. A known control arrangement particularly for controllable pumps has a mechanical feedback and a force equalization on a torque motor. Such an arrangement is relatively expensive and susceptible to failures.

SUMMARY OF THE INVENTION

Accordingly, it is an object of the present invention to provide an electrohydraulic control arrangement for a hydrostatic machine, which avoids the disadvantages of the prior art.

In keeping with these objects, and with others which will become apparent hereinafter, one feature of the present invention resides, briefly stated, in an electrohydraulic control arrangement for a hydrostatic machine with a pressure-actuated regulating piston adjusting a control member for a machine displacing element, and a valve slider through which a pressure medium acts upon the regulating piston and withdrawable to a neutral position in response to adjusting the machine by a feedback signal coming from the control member in correspondence with an electrical input signal, wherein a constant pressure acts upon one side of the valve slider, and a variable pressure depending on a position of the control member acts upon the other side of the valve slider.

When the control arrangement is designed in accordance with the present invention it has the advantage that it operates with a hydraulic feedback which is particularly advantageous for pumps inasmuch as the spatial arrangement of control members and adjustable pump parts does not encounter any problems.

Particularly, it is possible to utilize a control valve formed as a standard device without mechanical coupling means.

In accordance with another advantageous feature of the present invention, pressure-limiting valves are connected with high-pressure conduits of the machine and communicate with a hydraulic passage accommodating two throttles and connected with a constant-pressure valve and a pressure valve for the respective sides of the valve slider, wherein two further throttles are directly connected with the constant-pressure valve and the pressure valve. When the return flow of the pressure-limiting valve is connected with the hydraulic feedback, it is possible to provide loss-free pressure limiting of the pump in a simple manner and with small dimensions. It is also possible to reverse the supply direction of the pump.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENTS

Figure 1:
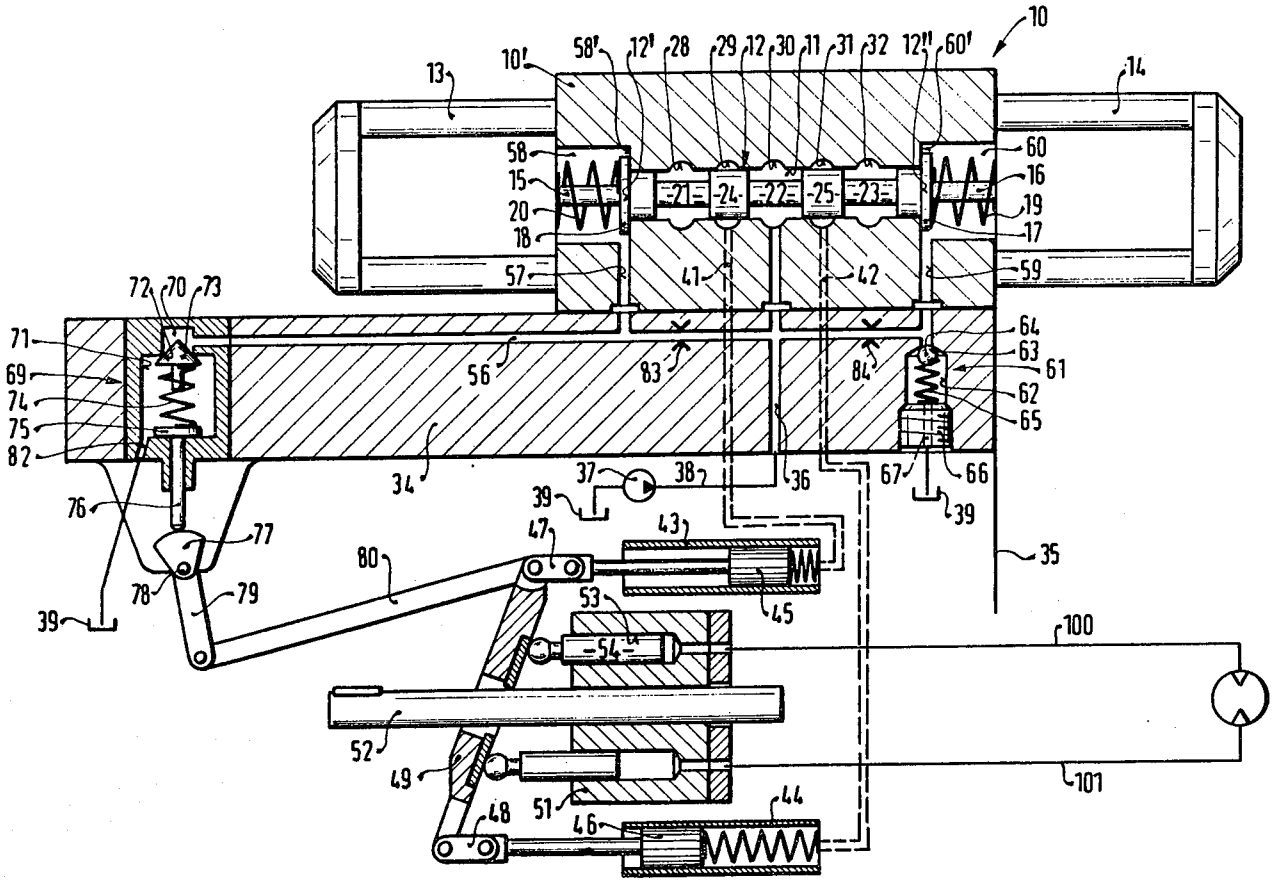
FIG. 1 is a view schematically showing a section of a control arrangement for an axial-piston pump in accordance with the present invention.

A control arrangement for a hydrostatic machine in accordance with the present invention shown in FIG. 1 has a 4/3-way valve identified by reference numeral 10. The valve 10 has a housing 10' with a longitudinal opening 11 in which a control slider 12 is slidingly guided. The control slider is adjusted with the aid of two electromagnets 13 and 14 via pusher rods 15 and 16 proportionally to an electrical input signal. It therefore forms an electromagnetically actuated proportional valve.

Pressure springs 19 and 20 act at both end sides 12' and 12'' upon the control slider via spring plates 17 and 18. The pressure springs 19 and 20 are selected so that they hold the control slider 12 in its central position. Three annular grooves 21, 22 and 23 are formed in the control slider 12. The annular grooves 21, 22 and 23 form two collars 24 and 25 therebetween. Five annular grooves 28, 29, 30, 31 and 32 are formed in the longitudinal opening 11 of the valve housing 10'.

The housing 10' is attached to a cover 34 of a schematically shown axial piston pump 35. A supply opening 36 is formed in the cover 34. An auxiliary pump 37 supplies pressure medium from a container 39 into the supply openings 36 via a conduit 38. The supply opening 36 open in the central annular groove 30 of the longitudinal opening 11. Control openings 41 and 42 extend from the neighboring annular grooves 29 and 31 of the longitudinal opening 11 and lead to regulating cylinder-and-piston units which have cylinders 43 and 44 with pistons 45 and 46 slidingly guided therein. The pistons 45 and 46 act via shackles 47 and 48 at diametrically opposite locations upon a turning disk 49 of the axial piston pump, in opposite directions. The axial piston pump includes in a known manner a cylindrical drum 51 driven in rotation by a driving shaft 52. The cylindrical drum 51 has openings 53 for plungers 54 which are supported at their outer ends on the turning disk 49.

A passage 56 is provided in the cover 34 and opens in the supply opening 36. An opening 57 leads from the passage 56 to a pressure chamber 58 which accommodates the spring plate 18 and the spring 20. An opening 59 leads from the passage 56 to a pressure chamber 60 which accommodates the spring plate 17 and the spring 19. The opening 59 merges in an increased opening 62 of a constant pressure valve 61, wherein a shoulder 63 forms a valve seat for a spherical valve member 64. The valve member 64 is loaded by a pressure spring 65 which is supported on a screw 66 screwed in the opening 62. An opening 67 is formed in the screw 66 and communicates the opening 62 with a container 39.

The other end of the passage 56 opens in an opening 70 of a probe valve 69 which merges into an increased opening 71. The transition thereof forms a valve seat 72 for a conical valve member 73 loaded by a pressure spring 74. The pressure spring 74 is supported on an adjustable spring abutment 75. The latter has a pin 76 against which a curved disk 77 abuts. The curved disk 77 together with a shackle 79 turns about an axis 78, and the shackle 79 is articulately connected with a connecting rod 80 which in turn is articulately connected with the turning disk 49. Thus a lever transmission is formed. The curved disk 77 is formed so that with increasing turning angle of the turning disk 49 the pretensioning force of the spring 74 increases. The opening 71 is connected with the container 39 via an outwardly open opening 82.

Throttles 83 and 84 are provided in the passage 56 at both sides of a location at which the passage 56 opens in the opening 36. In other words, the throttles 83 and 84 are connected in series with the valves 61 and 69, respectively.

The regulating cylinders are actuated via the valve 10 in counterphase with the pressure medium stream branching from the supply circuit of the auxiliary pump 37. The control slider 12 takes charge of the direction control. The position of the control slider 12 in the valve housing 10, and thereby the connection, which is throttled, to the control openings 41 and 42 is obtained from cooperation of different forces. The first force is a resulting magnetic force from the proportional electromagnets 13 and 14. A further force is a constant fluid-pressure force which acts on the right end side 12' of the control slider, with substantially half-pressure of the pressure generated by the auxiliary pump 37. This pressure force is obtained via the throttle 84 and the shut-off pressure of the pressure valve 61, via which the pressure medium flows out to the container 39 in the event of the lifted valve member.

At the left end side 12'' of the control slider, a pressure force acts which is formed from the throttle 83 and the shutoff pressure of the probe valve 69, which in turn is dependent upon the position of the curved disk 77 and thereby the turning disk 49. The pretensioning of the spring 74 increases via the lever transmission 80 and the curved disk 77 with increase in the turning angle of the turning disk 49, and proportionally thereto. Moreover, the resulting spring force of the springs 19 and 20 acts upon the control slider 12 so as to hold the latter in its central position.

The electromagnets 13 and 14 are supplied with an electrical control signal from an amplifier of a known construction so that their resulting force is proportional to the electrical input signal for adjusting the turning disk 49. The relation between the electrical input signal and the adjustment of the turning disk is obtained from the fact that, as to the position of the turning disk, a stationary condition is obtained when the sum of all forces acting upon the control slider 12 are so selected that the control slider is settled in the central position. Then the connection from the auxiliary pump 37 to the control openings 41 and 42 is interrupted.

In this position the force of the springs 19 and 20 disappears, inasmuch as they now abut against shoulders 58' and 60', of the pressure chambers 58 and 60. The differential between the constant pressure force of the pressure chamber 60 acting at the end side 12'' and the turning-angle-dependent pressure force acting at the left end side 12' is equal to the resulting magnetic force and thereby to the electrical input signal for adjusting the axial-piston pump. Under the pressure force the fluid force and the spring force is understood, as mentioned above. Because of the proportionality between this pressure differential and the position of the turning disk, which is guaranteed by the lever transmission 80, there is also a proportionality between the electrical input signal and the turning of the turning disk 49. The working direction of the control slider 12 is so determined that, during its control by a force disequilibrium, a change in the feedback signal (depending upon the angular position of the turning disk) at the left end side 12' of the control slider leads again to its return to the neutral position (negative follow-up of the feedback signal).

Figure 2:
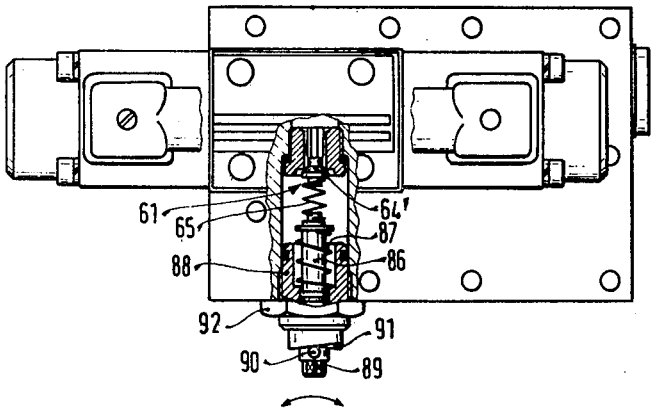
FIG. 2 is a view showing a fragment of the control arrangement of FIG. 1.

For such a control arrangement a so-called zero-point control of the turning disk by the control slider is important. This is shown in FIG. 2, which illustrates the constant-pressure valve 61. The adjustment of the zero point is performed by adjustment of the feedback signal pressure level. For this purpose, a spring 65 of the valve formed as a conical seat valve abuts against a pin 86. A pressure spring 87 arranged in a threaded sleeve 88 acts upon the pin 86 and has a greater pretension than the spring 65. The pin 86 extends through the threaded sleeve 88 and carries at its outer end a square 89. A pin 90 extends radially through the pin 86 and abuts against an inclined plane 91 of the threaded sleeve 88, and the pin 86 can displace axially.

For the zero-point control or adjustment, so as to bring the control slider into exactly its neutral position, the opening pressure of the valves 61 and 69 must be equalized. In the zero position of the turning disk 49 the slider 12 is adjusted in its zero position by controlling the pretensioning of the spring 65 of the constant-pressure valve 61. This is performed by more or less deep screwing of the threaded sleeve 88 with a released counternut 92.

When during the operation a disturbance in the valve 10, for example because of failure of an electromagnet, takes place, and the control slider 12 assumes a not planned position, a manual emergency control is actuated. For this purpose, the pin 86 is turned either rightwardly or leftwardly, in dependence upon whether the turning disk must be more or less adjusted, the pin 90 slides along the inclined plane 91 and the pin 86 is inserted deeper or moved further outwardly. Thereby the pretension of the spring 65 is changed in the manner desired.

Changing of a response pressure of the probe valve 69 can be performed by turning the curved disk 77, for example by an eccetric pin.

Figure 3:
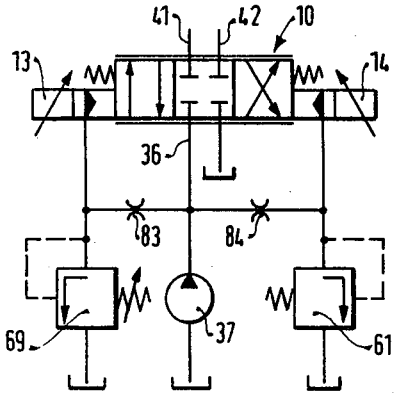
FIG. 3 is a view showing a circuit diagram.

FIG. 3 schematically shows the control valve together with hydraulic feedback.

For adjusting the valve 10, it is possible to use in known manner only one proportional magnet. It is also sufficient for turning the turning disk to provide only one regulating cylinder-and-piston unit. The counterforce can be provided in this case by a spring or by a righting moment of the piston 45.

A pressure medium source for the control stream can be formed as any hydraulic source. For example, a control stream can be branched from the machine to be controlled. Two conduits 100 and 101 lead from the axial piston pump 45 to a hydraulic motor.

Figure 4:
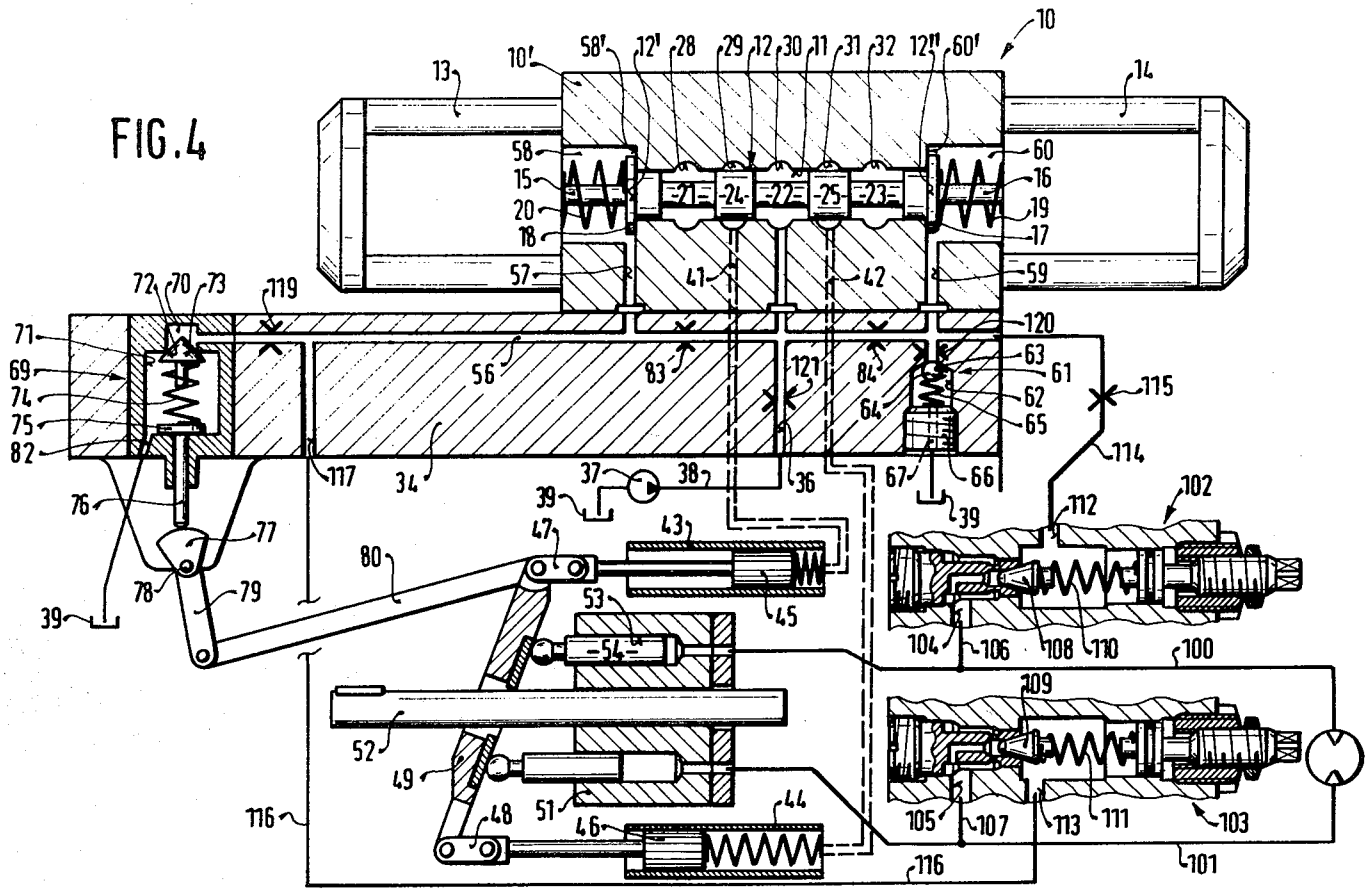
FIG. 4 is a view substantially corresponding to the view of FIG. 1, but showing the inventive control arrangement in accordance with a further embodiment.

A control arrangement in accordance with the embodiment shown in FIG. 4 differs from the above-described arrangement in that it makes possible to provide in a simple manner a so-called loss-free pressure-limiting action. In other words, in the event of exceeding a predetermined high pressure in the respective high-pressure conduits 100 and 101, the pump is turned back, if necessary to zero stroke, so as to avoid power losses. This takes place when the high pressure must be built via a pressure-limiting valve for low-pressure side, which leads to a strong oil heating and power loss since the pump then further delivers.

This is avoided in accordance with the present invention by connecting pressure-limiting valves 102 and 103 with the respective conduits 100 and 101. Inlets 104 and 105 of these valves are connected via conduits 106 and 107 with the conduits 100 and 101. Each valve has a valve member 108 and 109 which is pressed by a spring 110 and 111 against its valve seat. The valves 102 and 103 have outlets identified by reference numerals 112 and 113. A conduit 114 with a throttle 115 leads from the outlet 112 of the valve 102 to the passage 56 in the cover 34. A conduit 116 leads from the outlet 113 of the valve 103 to an opening 117 in the cover 34, which also opens in the passage 56. Between the location at which the opening 117 opens in the passage 56 and the location at which the opening 70 opens in the probe valve 69, a throttle 119 is arranged in the passage 56. The opening 59 has a portion located in the cover 34 and provided with a throttle 120 immediately before the location of its merging into the opening 62 of the valve 61. Furthermore, a throttle 121 is formed in the openings 36 of the cover 34. The throttles 115 and 121 serve for quantity-limiting purposes.

In the control arrangement in accordance with this embodiment, it is provided that the maximum displacement angle of the turning disk 49 is limited upon attaining a desirable pressure. Thereby it is prevented that the pump, for example in the event of excessive volume flow, must be carried away via a pressure-limiting valve. With a fixedly given nominal value in the electromagnets 13 and 14, the control slider 12 can superimpose a further signal which is predetermined by the pressure-limiting valves 102, 103.

In the shown position of the axial-piston pump, the magnet 13 is energized, the pressure in the pressure chamber 60 is higher than in the pressure chamber 58. The resulting force differential is in equilibrium with the force of the electromagnet 13. The control slider 12 now stands in its central position. A continuous control pressure medium stream from the auxiliary pump 37 flows now, on the one hand, in the passage 56 via the throttles 83, 119 and the probe valve 69 to the container and, on the other hand, via the throttles 84, 120 and the valve 61 also to the container. The pressure drop on the throttle 119 is proportional to the control oil stream, and the latter is proportional to the deflection of the probe valve 69. Each position of the turning disk 49 is thereby associated with a predetermined pressure drop at the throttles 119, 120. The combination of the throttle 119 and the probe valve 69, on the one hand, and the throttle 120 and the constant-pressure valve 61, on the other hand, gives these valves a desirable pressure characteristic increasing in dependence upon the through-flow. The dimensioning is such that no undesirable affecting of the control characteristic line takes place.

It is assumed that the conduit 100 is a high-pressure conduit, and the conduit 101 is then a low-pressure conduit. When the pressure in the conduit 100 attains the adjustment pressure of the pressure-limiting valve 102, it opens and the flowing out pressure medium travels via the conduit 114 in the passage 56 and from there to the constant-pressure valve 61 via the throttle 120. The passage 56 thereby receives a pressure medium quantity greater than before, and as a result of this a pressure increase corresponding to the increasing characteristic line. The thus produced increased return force on the control slider 12 acts for deflecting the same leftwardly against the force of the spring 20. Thereby the pressure medium supplied from the auxiliary pump 37 can flow in the control opening 41 and the cylinder 43, whereby the pump is returned. A new rest position takes place first when an equilibrium between the magnetic force and the pressure forces at the end sides of the control slider is obtained. This can continue until the axial-piston pump reverses and supplies pressure medium into the conduit 101.

When the conduit 101 is a high-pressure conduit and the pressure adjusted at the pressure-limiting valve 103 is exceeded there, the pressure medium flows from the conduit 101 via the pressure-limiting valve in the conduit 116, the opening 117 and in the passage 56. The higher pressure which now acts in the opening 57 via the valve 119 displaces the control slider 12 against the force of the spring 19 rightwardly, so that now the pressure medium supply from the auxiliary pump 37 can flow via the passage 42 into the cylinder 46. The pump is thereby again reversed.

In this simple manner, a so-called loss-free pressure-limiting action is obtained. In other words, excessive pressure medium must not be continuously released via a pressure-regulating valve, which leads to power loss and strong oil heating, but instead the pump is reversed, and if necessary until a nil flow or in the opposite flow direction. The throttles arranged in the passage 56 form a hydraulic bridge connection which is so determined, in dependence upon the working pressure, that the loss-free pressure-limiting action is provided.

Figure 5:
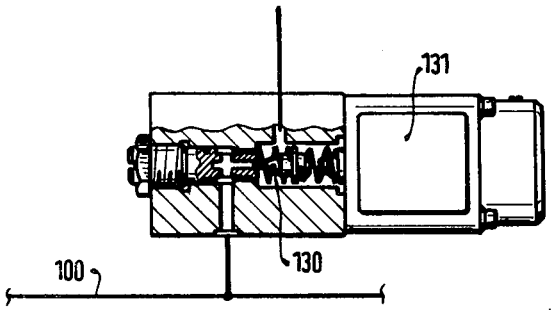
FIG. 5 is a view showing an embodiment somewhat differing from the embodiment of FIG. 4.

The control arrangement a part of which is shown in FIG. 5 differs from the arrangement of FIG. 4 in that the pressure-limiting valve connected with the conduit 100 and identified here by reference numeral 130 is adjustable by an outer signal which comes, for example, from an external electrical transformer 131. This signal can be a braking pressure from a hydrostatic braking system, or an electrical signal. The simplification takes place because such a valve is connected only with the conduit 100. It is to be understood that such a valve can also be connected with the conduit 101.

It will be understood that each of the elements described above, or two or more together, may also find a useful application in other types of constructions differing from the types described above.

While the invention has been illustrated and described as embodied in an electrohydraulic control arrangement for a hydrostatic machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electrohydraulic control arrangement for a hydrostatic machine communicating with at least one high pressure conduit and having a displacing element with a stroke determined by a control member movable between a plurality of positions, the arrangement comprising at least one pressure-actuated regulating piston arranged to adjust the control member;

at least one proportionally operating electro magnet;

centering spring means;

a valve slider through which a pressure medium acts upon said regulating piston arranged so that said proportionally operating magnet acts upon said valve slider and said centering spring means holds said valve slider in a central position, said valve slider being withdrawable to a neutral position in response to adjusting the machine by a feedback signal coming from the control member in correspondence with an input electric signal, said valve slider having two sides arranged so that one of said sides is acted upon by a constant pressure, whereas the other of said sides is acted upon by a variable pressure depending on a position of the control member;

means for acting upon said side of said valve slider with a constant pressure; and means for acting upon said other side of said valve slider with a variable pressure depending on a position of the control member.

2. An electrohydraulic control arrangement for a hydrostatic machine communicating with at least one high pressure conduit and having a displacing element with a stroke determined by a control member movable between a plurality of positions, the arrangement comprising at least one pressure-actuated regulating piston arranged to adjust the control member;

at least one proportionally operating electro magnet;

centering spring means;

a valve slider through which a pressure medium acts upon said regulating piston arranged so that said proportionally operating magnet acts upon said valve slider and said centering spring means holds said valve slider in a central position, said valve slider being withdrawable to a neutral position in response to adjusting the machine by a feedback signal coming from the control member in correspondence with an input electric signal, said valve slider having two sides arranged so that one of said sides is acted upon by a constant pressure, whereas the other of said sides is acted upon by a variable pressure depending on a position of the control member; and means providing the constant pressure acting upon said one side of said valve slider, said constant pressure providing means including a conduit branching from said pressure medium source, a first throttle, and a constant pressure valve arranged so that a first pressure medium stream flows from said pressure medium source via said branching conduit, said first throttle and said constant pressure valve.

3. An arrangement as defined in claim 2, wherein the control member is turnable; and further comprising means providing said variable pressure acting upon said other side of said valve slider, said variable pressure providing means including a second throttle, and a pressure valve which has a response pressure changing proportionally to a turning angle of the control member and is arranged so that a second pressure medium stream flows through said second throttle and said pressure valve.

4. An arrangement as defined in claim 3; and further comprising a lever transmission actuated by the control member, and a curved disc connected to said lever transmission and arranged so that the response pressure of said pressure valve is changeable via said lever transmission and said curved disc and in such a manner that the response pressure increases with an increase in the turning angle of the control member.

5. An arrangement as defined in claim 3, wherein said pressure valve has a spring with pretensioning which is changeable for zero position adjusting of said valve slider and the control member.

6. An arrangement as defined in claim 5, wherein said spring is arranged so that its pretensioning is adjustable for a manual control in the event of failure of said electromagnet, independently on the zero adjustment.

7. An arrangement as defined in claim 3, wherein the hydraulic machine communicates with two such high pressure conduits; and further comprising means forming a passage in which said first and second throttles are located and which is supplied from said auxiliary pump, two pressure limiting valves each connected with a respective one of the high pressure conduits and having an outlet communicating with said passage, and third and fourth throttles arranged in said passage so that said constant pressure valve and said pressure valve are directly connected with said third throttle and said fourth throttle, respectively.

8. An arrangement as defined in claim 7, and further comprising means forming a supply conduit connecting one of said pressure limiting valves with said passage and provided with a further throttle.

9. An arrangement as defined in claim 7, wherein one of said pressure limiting valves is formed as a valve with an adjustable shut off pressure.

10. An arrangement as defined in claim 9, and further comprising means for adjusting the shut-off pressure of said one pressure limiting valve and including an electromagnet and a transformer controlling the latter.

11. An arrangement as defined in claim 2, and further comprising a container, and an auxiliary pump providing a pressure medium stream which branches so that a half stream flows via said first throttle to said constant pressure valve and to said container.

12. An electrohydraulic control arrangement for a hydrostatic machine communicating with at least one high pressure conduit and having a displacing element with a stroke determined by a control member movable between a plurality of positions, the arrangement comprising at least one pressure-actuated regulating piston arranged to adjust the control member;

at least one proportionally operating electro magnet;

centering spring means;

a valve slider through which a pressure medium acts upon said regulating piston arranged so that said proportionally operating magnet acts upon said valve slider and said centering spring means holds said valve slider in a central position, said valve slider being withdrawable to a neutral position in response to adjusting the machine by a feedback signal coming from the control member in correspondence with an input electric signal, said valve slider having two sides arranged so that one of said sides is acted upon by a constant pressure, whereas the other of said sides is acted upon by a variable pressure depending on a position of the control member; and a multiway valve of which said valve slider is a part, a second proportionally operating electromagnet arranged so that said first-mentioned and second electromagnets act on said valve slider in two opposite directions, and a second regulating piston arranged so that said first-mentioned and second regulating pistons control the control member in two opposite directions.

* * * * *